US008100524B2

(12) United States Patent
Tanaka et al.

(10) Patent No.: US 8,100,524 B2
(45) Date of Patent: Jan. 24, 2012

(54) STAGE APPARATUS

(75) Inventors: Yasuzo Tanaka, Chigasaki (JP); Junpei Yuyama, Chigasaki (JP); Mitsuru Yahagi, Chigasaki (JP); Hirofumi Minami, Chigasaki (JP); Makoto Takahashi, Hidaka (JP); Shinya Ito, Hidaka (JP)

(73) Assignee: Ulvac, Inc., Chigasaki-shi (JP)

( * ) Notice: Subject to any disclaimer, the term of this patent is extended or adjusted under 35 U.S.C. 154(b) by 0 days.

(21) Appl. No.: 12/712,579

(22) Filed: Feb. 25, 2010

(65) Prior Publication Data

US 2010/0177153 A1 Jul. 15, 2010

Related U.S. Application Data

(63) Continuation of application No. PCT/JP2008/065245, filed on Aug. 27, 2008.

(30) Foreign Application Priority Data

Aug. 28, 2007 (JP) ..... 2007-221405

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS 6,652,054 B2 * 11/2003 Regev et al. ..... 347/8

FOREIGN PATENT DOCUMENTS

| | | | |
|---|---|---|---|
| JP | 7-124831 | | 5/1995 |
| JP | 1995-7-124831 | * | 5/1995 |
| JP | 1995-7-124831 A | * | 5/1995 |
| JP | 2004-209411 A1 | | 7/2004 |
| JP | 2007-73688 A1 | | 3/2007 |
| JP | 2008-23699 A1 | | 2/2008 |
| JP | 2008-93651 A1 | | 4/2008 |

OTHER PUBLICATIONS

International Search Report for International Application No. PCT/JP2008/065245 dated Oct. 24, 2008.

* cited by examiner

*Primary Examiner* — Stephen Meier
*Assistant Examiner* — Alexander C Witkowski
(74) *Attorney, Agent, or Firm* — Kratz, Quintos & Hanson, LLP

(57) ABSTRACT

A stage apparatus that achieves a high accuracy in assembling and enables easy work at a real installation site. In a stage apparatus of the present invention, sub rails are arranged on respective sub base plates, which are connected respectively with the first and second main rails on a main base plate to extend the first and second main rails. Accordingly, when the sub base plates are fixed to the main base plate 11 with positional alignment performed therebetween, the accuracy in positional alignment of the sub base plates which has already been fixed to the main base plate is not affected.

2 Claims, 9 Drawing Sheets

STAGE APPARATUS

This application is a continuation of International Application No. PCT/JP2008/065245, filed Aug. 27, 2008, which claims priority from Japan Patent Application No. 2007-221405, filed Aug. 28, 2007. The contents of the prior application is herein incorporated by reference in its entirety.

BACKGROUND OF THE INVENTION

The present invention generally relates to a technical field of stage apparatuses, and particularly relates to a disassemblable stage apparatus.

Reference numeral 105 in FIG. 9 represents a stage apparatus of a prior art.

The stage apparatus 105 includes a base plate 111, and the base plate 111 is mounted on a floor with leg sections 112*a* to 112*d* disposed at the four corners on the back surface side.

Rails 117 and 118 are arranged on the surface of the base plate 111, and a gantry 113 is mounted thereon. A print head is disposed on the surface of the gantry 113 facing the base plate 111. The print head is connected with a tank 114, which supplies the print head with ejection liquid; and when a substrate 107 is mounted on the base plate 111 and ejection liquid is ejected from the print head, the ejection liquid lands on the substrate 107.

The gantry 113 is arranged movable on the rails 117 and 118; and when the gantry 113 ejects ejection liquid above the substrate 107, as shown in FIG. 10, it is possible to land the ejection liquid on a desired position of the surface of the substrate 107.

This ejection liquid is, for example, a raw material of an organic thin film for a liquid crystal oriented film, spacer dispersion liquid of a liquid crystal display device, raw material of a light emitting layer of an organic EL device, or the like; and the stage apparatus 105 is used to eject ejection liquid onto a large substrate.

However, substrates as an object of ejection are becoming larger and larger, and correspondingly, stage apparatuses are becoming larger; which makes it difficult to transport a stage apparatus fabricated at a factory to an installation site because of the problems in terms of cost and due to law restrictions. In such circumstances, countermeasure is taken even in conventional arts, and it has been tried to transport a base plate by dividing it.

See, Japanese Patent Document No. 2007-73688.

SUMMARY OF THE INVENTION

However, there are problems in assembling a base plate once it has been divided at an installation site. Such problems include requiring a lot of work for position adjustment; and in connecting rails, if the accuracy of assembling rails is low, the running of the print head becomes unstable.

In order to solve the above-described problems, an embodiment of the present invention is directed to a stage apparatus, comprising: a main base plate in a quadrilateral shape; two sub base plates which are fixed to one side of the main base plate and separable each other; and a movable member arranged to be movable between a position above the main base plate and a position the two sub base plates fixed to the main base plate, wherein the two sub base plates are separable from the main base plate.

An embodiment of the present invention may be directed to a stage apparatus, further comprising: a first and second main rails which are linearly extended on the main base plate and disposed in parallel to each other; and sub rails that are respectively disposed on the two sub base plates and respectively connected to end portions of the first and second main rails, wherein the movable member runs on the first and second main rails and the sub rails on the two sub base plates and are movable between the position above the main base plate and the position above and between the two sub base plates.

As the positions of the first and second sub base plates can be independently aligned with a main base plate, the work for position alignment at a real installation site is easy; and the position alignment accuracy is improved.

BRIEF DESCRIPTION OF THE DRAWINGS

FIG. 1(*b*) is a side view thereof.

FIG. 2(*b*) is a side view thereof.

FIG. 5(*b*) is a side view thereof.

FIG. 6(*b*) is a side view thereof.

FIG. 9(*b*) is a side view (1) thereof.

FIG. 10(*b*) is a side view (2) thereof.

DETAILED DESCRIPTION OF THE INVENTION

Figure 5A:
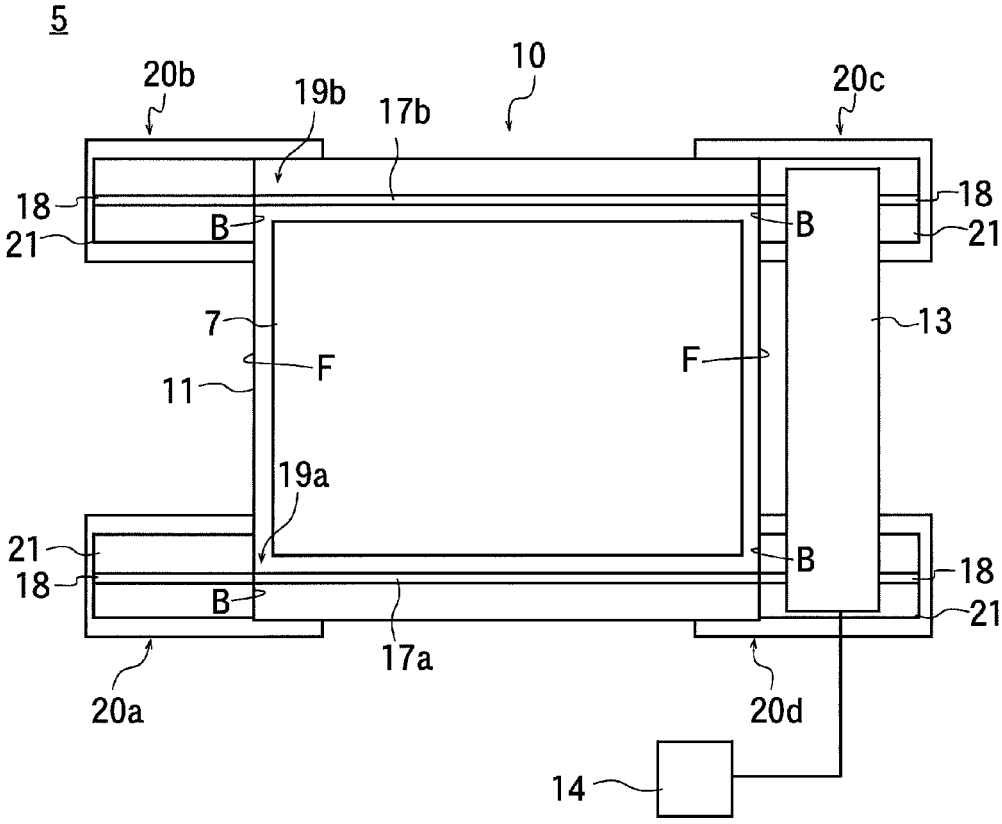
FIG. 5(*a*) is a plan view of an example of a stage apparatus in accordance with an embodiment of the present invention.
Figure 5B:
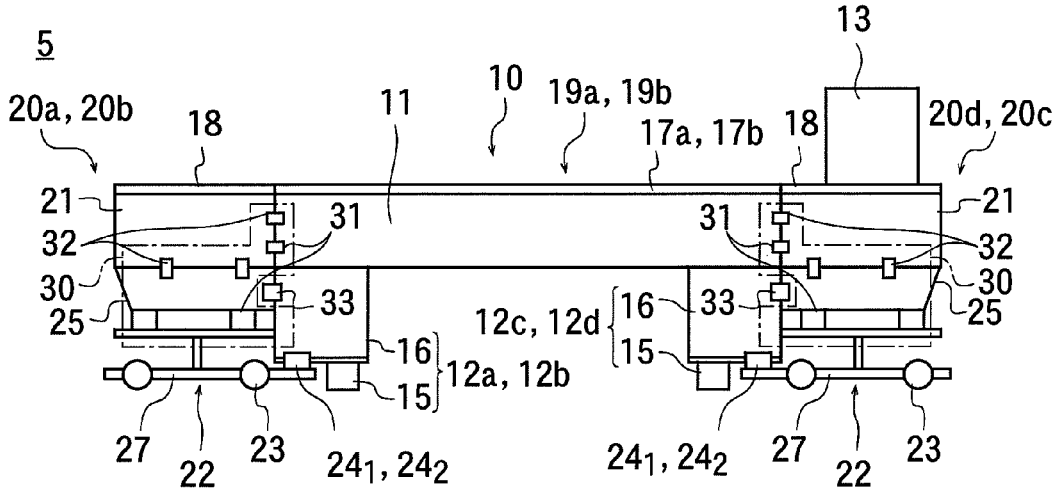

Reference numerals 5 in FIGS. 5(*a*) and 5(*b*) represent a stage apparatus of the invention. FIG. 5(*a*) is a plan view, and FIG. 5(*b*) is a side view.

This stage apparatus 5 includes one main mounting table 10 and two or four (in this embodiment, four) sub mounting tables 20*a* to 20*d*.

At the upper portions of the main mounting table 10 and sub mounting tables 20*a* to 20*d*, the main base plate 11 and sub base plates 21, which are in a quadrilateral shape and have the flat surfaces, are arranged.

First and second main rails 17*a* and 17*b*, which are in parallel to each other, are arranged on the surface of the main base plate 11; and one sub rail 18 is disposed on the surface of each sub base plate 21.

The first and second main rails 17*a* and 17*b* are arranged in parallel to two out of the four sides of the main base plate 11 and perpendicular to the other two sides; and at least one end of the first and second main rails 17*a* and 17*b* extends up to the same one side out of the four sides of the main base plate 11, the one side being perpendicular to the first and second main rails 17*a* and 17*b*.

In this embodiment, both ends of the first and second main rails 17*a* and 17*b* extend up to the two sides that are perpendicular to the first and second main rails 17*a* and 17*b*.

The sub rails 18 are arranged in parallel to two out of the four sides of the sub base plates 21, and perpendicular to the other two sides. At least one of the both ends of each sub rail 18 extends up to one side perpendicular to the sub rails 18.

The surfaces of the main base plate 11 and sub base plates 21 are arranged so as to be horizontal at the same height.

Out of the four sides of the main base plate 11, the two sides, at which the end portions of the first and second main rails 17*a* and 17*b* are located, will be referred to as main connection sides F, and the sides, at which one of the ends of the sub rails 18 is located, will be referred to as sub connection sides B. The respective sub mounting tables 20*a* to 20*d* are arranged such that the sub connection sides B of the sub base plates 21 are in tight contact with the main connection sides F of the main base plate 11, so that the end portions of the sub rails 18 on the sub base plates 21 at the upper portions of the mounting tables 20*a* to 20*d* are in tight contact with the end portions of the first and second main rails 17*a* and 17*b*; in a case of two sub mounting tables, the main rails 17*a* and 17*b* are arranged so as to extend on the same side by the respective sub rails 18; and in a case of four sub mounting tables, both ends of each of the first and second main rails 17*a* and 17*b* are in tight contact with the respective ends of sub rails 18, and the first and second main rails 17*a* and 17*b* extend along the direction of both ends by the respective sub rails 18.

In the figure, reference symbols 19*a* and 19*b* respectively represent the first and second extended rails extended from the first and second main rails 17*a* and 17*b* by the sub rails 18.

A gantry 13 being a movable member is disposed on the main base plate 11. A print head (not shown) is provided at the bottom surface portion of the gantry 13. The gantry 13 is connected with a tank 14 containing ejection liquid.

When ejection liquid is supplied from the tank 14, and then ejection mechanism inside the print head is operated, the ejection liquid is ejected from a plurality of ejection holes provided on the print head toward the main base plate 11.

A substrate 7 is arranged on a portion of the surface of the base plate 11, the portion being located between the main rails 17*a* and 17*b*.

The gantry 13 is mounted on the first and second extended rails 19*a* and 19*b* so as to be able to run on the extended rails 19*a* and 19*b*.

Figure 6A:
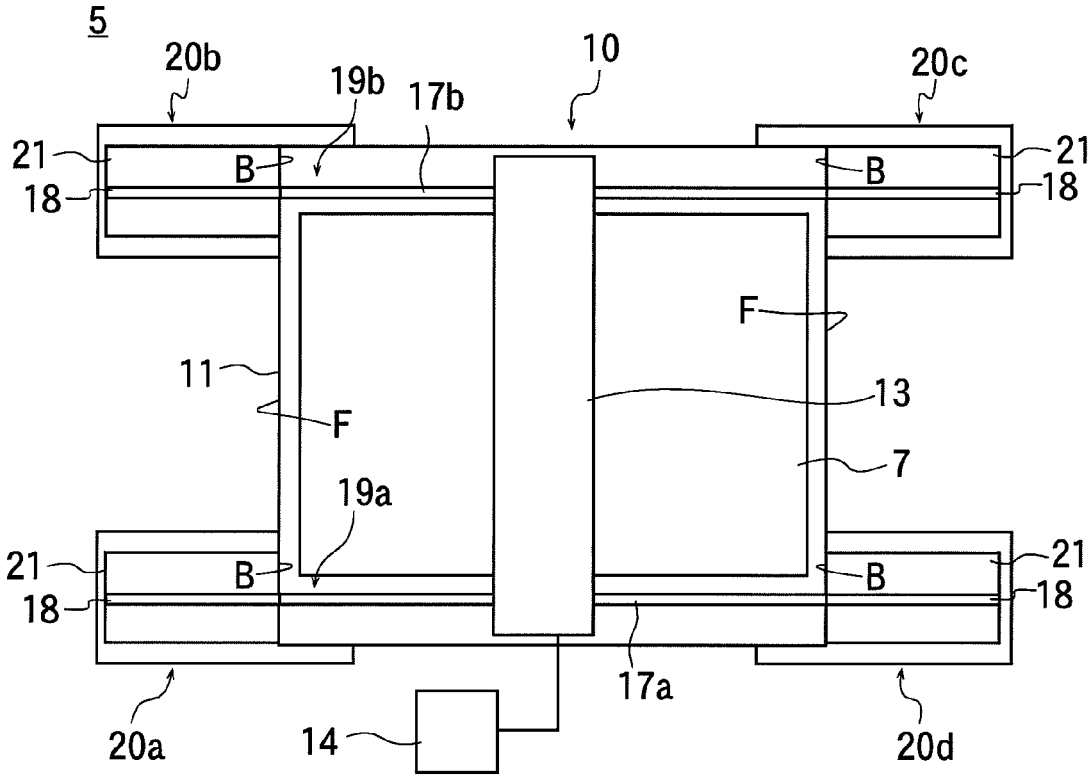
FIG. 6(*a*) is a plan view illustrating the stage apparatus in an operational state.
Figure 6B:
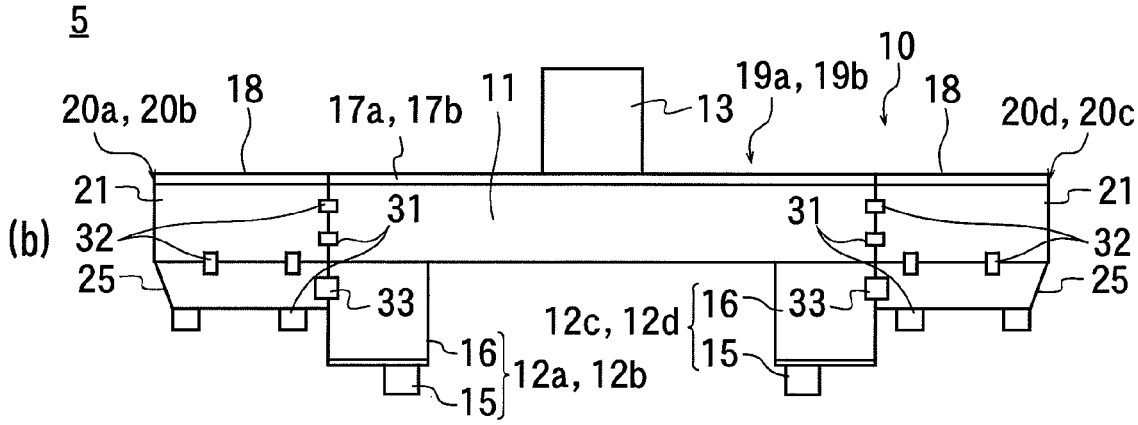

As ejection from the print head is controlled by a controller (not shown), as shown in FIGS. 6(*a*) and 6(*b*), when ejection liquid is ejected from the print head with the gantry 13 located above the substrate 7, the ejection liquid lands on the surface of the substrate 7. By moving the gantry 13, ejection liquid can be made to land on a desired position of the surface of the substrate 7.

Although the stage apparatus 5 is to be disposed at a stand installation site where ejection work onto the substrate 7 is performed, as the main base plate 11 is large, the stage apparatus 5 cannot be transported from a temporary installation site (i.e., where the stage apparatus 5 has been assembled) to the real installation site in a state, as shown in FIGS. 5 and 6, with the sub mounting tables 20*a* to 20*d* connected to the main mounting table 10 so as to make the main base plate 11 and sub base plates 21 in contact with each other.

As in the configuration of the stage apparatus 5 to be used as an embodiment of the present invention, each of the sub mounting tables 20*a* to 20*d* is arranged so as to be independently detachable with respect to the main mounting table 10, with the sub mounting tables 20*a* to 20*d* attached, the sub connection sides B of the sub base plates 21 on each of the sub mounting tables 20*a* to 20*d* are in tight contact with the main connection sides F of the main base plate 11, while in a state where the sub mounting tables 20*a* to 20*d* are detached from the main base plate 11, the sub base plates 21 are separated from the main base plate 11 so as to be able to be independently transported.

With the above-described configuration, it is possible to perform the process of assembling at the temporary installation site; then disjoin after positional alignment; and transport from the temporary installation site to the real installation site; and the state of completion of positional alignment carried out at the temporary installation site is restored at the real installation site.

Figure 1A:
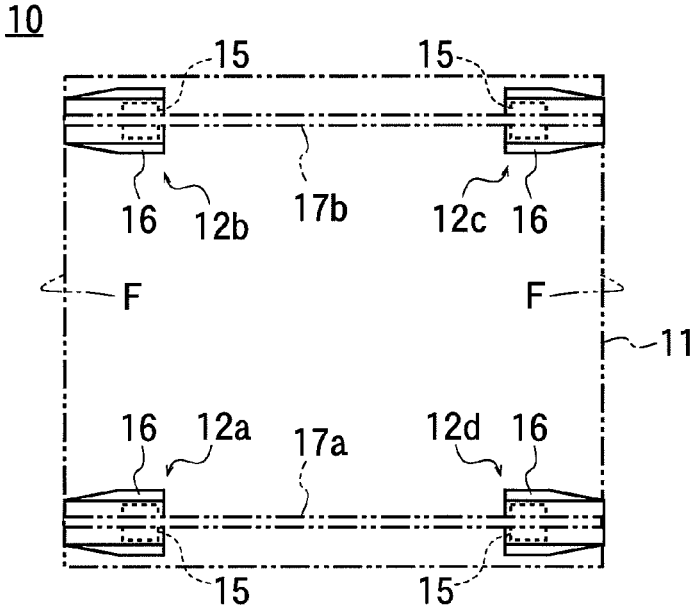
FIG. 1(*a*) is a plan view illustrating a main mounting table at a temporary installation site.
Figure 1B:
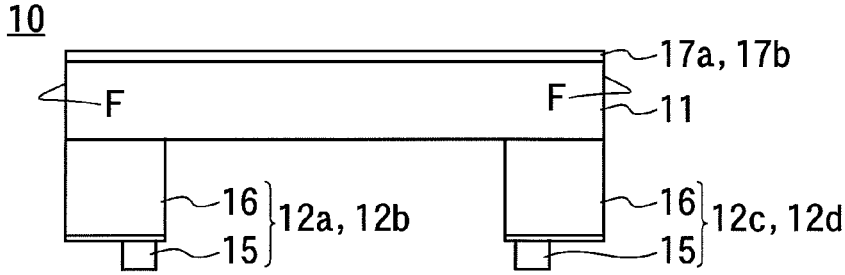

For use in describing the procedures, FIG. 1(*a*) is a plan view of the main mounting table 10 in a state of being disposed not at the real installation site but at the temporary installation site; and FIG. 1(*b*) is a side view of the main mounting table 10.

Leg portions 12*a* to 12*d* are disposed near the four corners of the backside surface of the main base plate 11.

Figure 3:
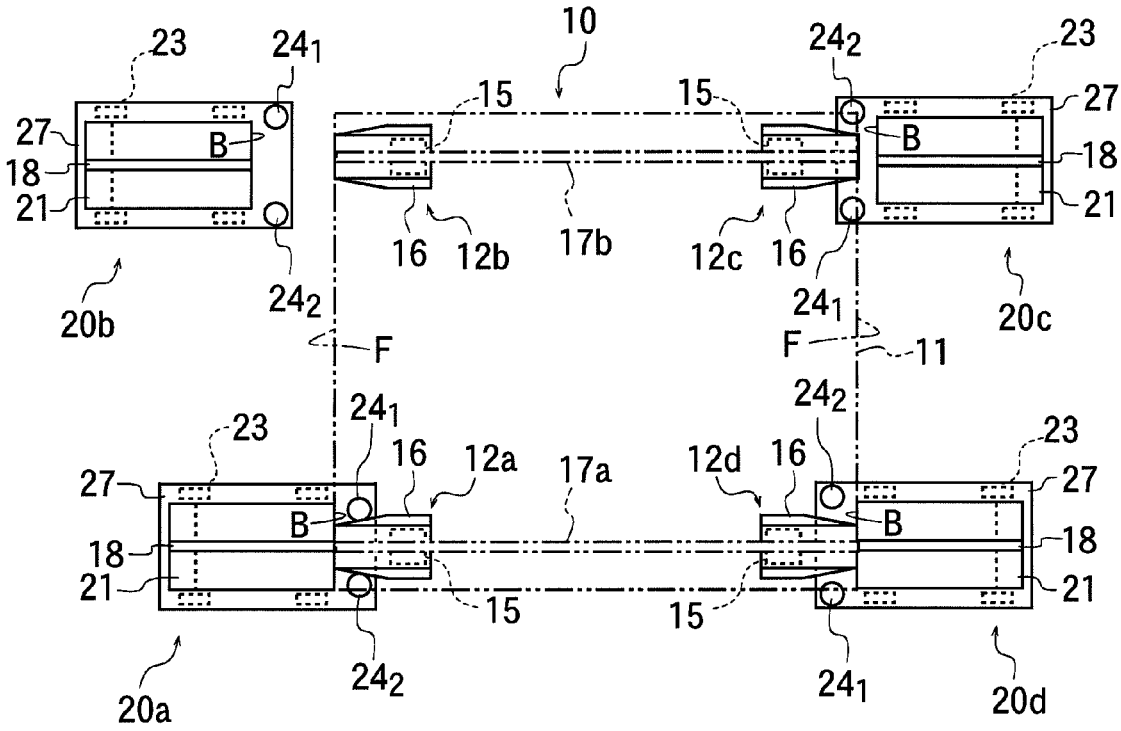
FIG. 3 is an inner plan view illustrating a procedure of coupling sub mounting tables with the main mounting table at a temporary installation site.

In FIG. 1(*a*) (and as discussed below with respect to FIGS. 3 and 4), the main base plate 11 and main rails 17*a* and 17*b* are shown by a chain of double-dashed lines, and part of the leg sections 12*a* to 12*d* are shown by solid lines. The leg sections 12*a* to 12*d* are fixed on the back surface of the main base plate 11.

Figure 2A:
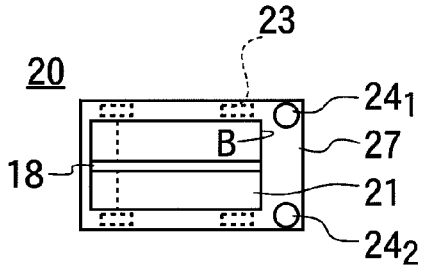
FIG. 2(*a*) is a plan view illustrating a sub mounting table at the temporary installation site.
Figure 2B:
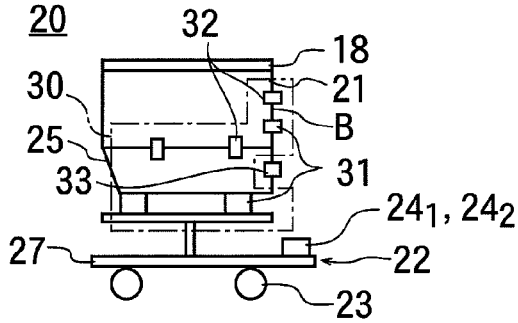

Next, FIG. 2(*a*) is a plan view of the sub mounting tables 20*a* to 20*d*; and FIG. 2(*b*) is a side view thereof.

The sub mounting tables 20*a* to 20*d* respectively have a carriage 22; and the sub base plates 21 are mounted on the respective carriages 22.

Each carriage 22 is provided with a plurality of transporting wheels 23. In this embodiment, the carriage 22 is provided with a pedestal 27, and the transporting wheels 23 are arranged at four portions of the bottom surface of the pedestal 27.

The main base plate 11 and sub base plates 21 are in a rectangular or square shape. Since the sub base plates 21 are set smaller than or equal to a half of the main base plate 11 in terms of size, two sub base plates 21 can be connected to each of the both sides of the main base plate 11.

Since the transporting wheels 23 are arranged so that the transporting wheels 23 are able to move in a forward and backward direction, the portions of the main base plates 11 on which the sub base plates 21 are connected to the main base plate 11 being considered the heads of the sub mounting tables 20*a* to 20*d*, when the transporting wheels 23 touch the floor and a force is applied in the forward or backward direction, the transporting wheels 23 rotate and the sub mounting tables 20*a* to 20*d* run on the floor in the direction along which the force is applied.

One or a plurality of sub positioning members $\mathbf{24}_1$, $\mathbf{24}_2$ formed of a roller and rotation shaft are arranged on a pedestal 27.

In this embodiment, two sub positioning members $\mathbf{24}_1$ and $\mathbf{24}_2$ are provided, being disposed separately from each other and locating on either side of the moving direction, at the heads of the forward direction of the sub mounting tables 20*a* to 20*d* on the pedestal 27.

The leg portions 12*a* to 12*d* are in contact with the floor, and have a support portion 15 supporting the main base plate 11 and a main positioning member 16 in the form of a plate provided on the perimeter side surfaces of the support section 15. The respective main positioning members 16 are disposed above the floor at a constant distance from the floor, and gaps are formed between the main positioning members 16 and the floor.

As the sub positioning members $24_1$ and $24_2$ are arranged such that they are movable and fixable with respect to the pedestals 27, with the distance between the sub positioning members $24_1$ and $24_2$ set in advance to be large, when the sub mounting table 20*d* (as the sub mounting table 20*d* shown in FIG. 3) is moved forward with the head portion thereof being directed toward the leg portion 12*d* so as to be the main rail 17*a*, or 17*b*, and the sub rail 18 being in a straight line, the pedestal 27 is inserted between the main positioning member 16 and the floor, as with the sub mounting table 20*a* shown in the figure.

The main positioning members 16 are disposed on the side surfaces (of the leg portions 12*a* to 12*d*) which are in parallel to the main rails 17*a* and 17*b*.

Each main positioning member 16 is disposed at the same height as the sub positioning members $24_1$ and $24_2$, while the distance between the sub positioning members $24_1$ and $24_2$ is set larger than the width of the main positioning member 16, so that the pedestal 27 is inserted under the main positioning member 16 without a contact between the sub positioning members $24_1$, $24_2$ and the main positioning member 16; and the sub base plate 21 and main base plate 11 contact each other, as with the sub mounting table 20*b* shown in the figure.

In this state, there is a large margin of error that differs from an ideal positional relationship between the main base plate 11 and sub base plate 21.

On the sub mounting tables 20*a* to 20*d*, adjustment mechanisms 30, which are capable of changing the respective heights, inclinations, and the horizontal positions and directions of the sub base plates 21, is provided.

Each of these adjustment mechanisms 30 includes a coarse adjustment mechanism 31 capable of generally changing the height, inclination, and horizontal position and direction of the sub base plate 21; and a fine adjustment mechanism 32 capable of changing in a more finely manner than is done with the coarse adjustment mechanism 31.

Since the coarse adjustment mechanism 31 is arranged so as to be able to change the height, inclination, and horizontal position to a larger extent than the fine adjustment mechanism 32, first, in each of the sub mounting tables 20*a* to 20*d*, the coarse positional adjustment mechanism 31 performs schematic position alignment of the sub base plate 21 with the main base plate 11.

Assuming that the floor of the temporary installation site is horizontal and that the main base plate 11 is set in advance by a main adjustment mechanism (not shown) provided on the main mounting table 10 such that the surface of the main base plate 11 is horizontal, the sub base plates 21 are made horizontal at almost the same height as the surface of the main base plate 11 and the relative positions and directions thereof with respect to the main base plate 11 are coarsely adjusted by the coarse adjustment mechanisms 31. Thus, schematic positional alignment is performed.

In this state, although some margin of error different from the state of ideal position alignment is still included, when an initial error $E_1$ represents the error amount (absolute value) before the coarse adjustment, and the coarse adjustment error $E_2$ represents the error amount (absolute value) after the coarse adjustment, the coarse adjustment error $E_2$ is smaller than the initial error $E_1$ by the amount which has been coarsely adjusted.

In a state subsequent to the coarse adjustment, the sub base plates 21 are in contact with the main base plate 11, so that the sub mounting tables 20*a* to 20*d* cannot move forward but can move along a left-right direction and backward.

Next, with the coarse adjustment mechanism 31 (i.e., the course adjustment screw) being fixed, and with the coarsely adjusted relative position between the sub base plate 21 and main base plate 11 being maintained so as not to change, when the sub positioning members $24_1$ and $24_2$ are moved and fixed to the pedestal 27 in a state of being in contact with the main positioning member 16, the main positioning member 16 is sandwiched by the sub positioning members $24_1$ and $24_2$.

Since the support portions 15 are located more toward the inside than toward the perimeter of the main base plate 11, and each main positioning member 16 is formed so as to be wider at the portion where it is distant from the perimeter of the base plate 11 and narrower at the portion where it is near the perimeter of the main base plate 11, in a state such that the positioning members $24_1$ and $24_2$ sandwich the main positioning members 16, the sub mounting tables 20*a* to 20*d* are able to move outward (backward) from the main base plate 11 and unable to move forward or in the left-right direction with respect to the leg portions 12*a* to 12*d*.

Next, with the use of the fine adjustment mechanisms 32, the respective heights, inclinations, and horizontal positions and directions of the sub base plates 21, and the positions of the sub base plates 21 with respect to the main base plate 11, are finely adjusted for each of the sub mounting tables 20*a* to 20*d*.

With respect to the error amount (absolute value) of the relative positional relationship between the sub base plates 21 and the main base plate 11 in a state of fine adjustment, the error amount differs from the ideal positional relationship by a fine adjustment error $E_3$, the fine adjustment error $E_3$ being nearly zero, wherein $E_1>E_2>E_3\approx 0$.

After the fine adjustment, the state of fine adjustment is maintained by fixing the fine adjusting screws of the fine adjustment mechanisms 32.

The stands 25 are disposed between the pedestals 27 and sub base plates 21. The sub base plates 21 are fixed to the stands 25. As the stands 25 are provided with coupling members 33, when the stands 25 are fixed to the leg portions 12*a* to 12*d* by the coupling members 33, the relative position between the main base plate 11 and the sub base plates 21 is fixed via the stands 25 and leg portions 12*a* to 12*d* in a state such that the coarse adjustment and the fine adjustment have been performed.

By the above-described procedure, the stage apparatus 5 is assembled in a state such that the positions of the sub base plates 21 and the position of the main base plate 11 are aligned with each other, and the sub rails 18 are connected straight to both ends of the main rails 17*a* and 17*b*; and thus, the first and second extended linear rails 19*a* and 19*b* are obtained.

After performing the above-described temporary assembling at the temporary installation site (i.e., when the coupling members 33 are removed), the couplings between the main mounting table 10 and sub mounting tables 20*a* to 20*d* are released, and the sub mounting tables 20*a* to 20*d* are moved back so that the main table 10 and the sub mounting tables 20*a* to 20*d* are separated from each other, the main mounting table 10 and the sub mounting tables 20*a* to 20*d* approaching a state that allows individual transportation.

At this time, the fixation of the sub positioning members $24_1$ and $24_2$ is not released, and the distance between the sub positioning members $24_1$ and $24_2$ is not changed. Further, fixation of (coarse adjustment screw and fine adjustment screw of) the coarse adjustment mechanisms 31 and fine adjustment mechanisms 32 is maintained so that a state of having the coarse adjustment and the fine adjustment completed does not change.

The main mounting table 10 and sub mounting tables 20*a* to 20*d* are individually loaded on a vehicle or the like, and transported to the real installation site by land, sea, or the like, and then, the main mounting table 10 is disposed at a predetermined position of the real installation site.

Figure 7:
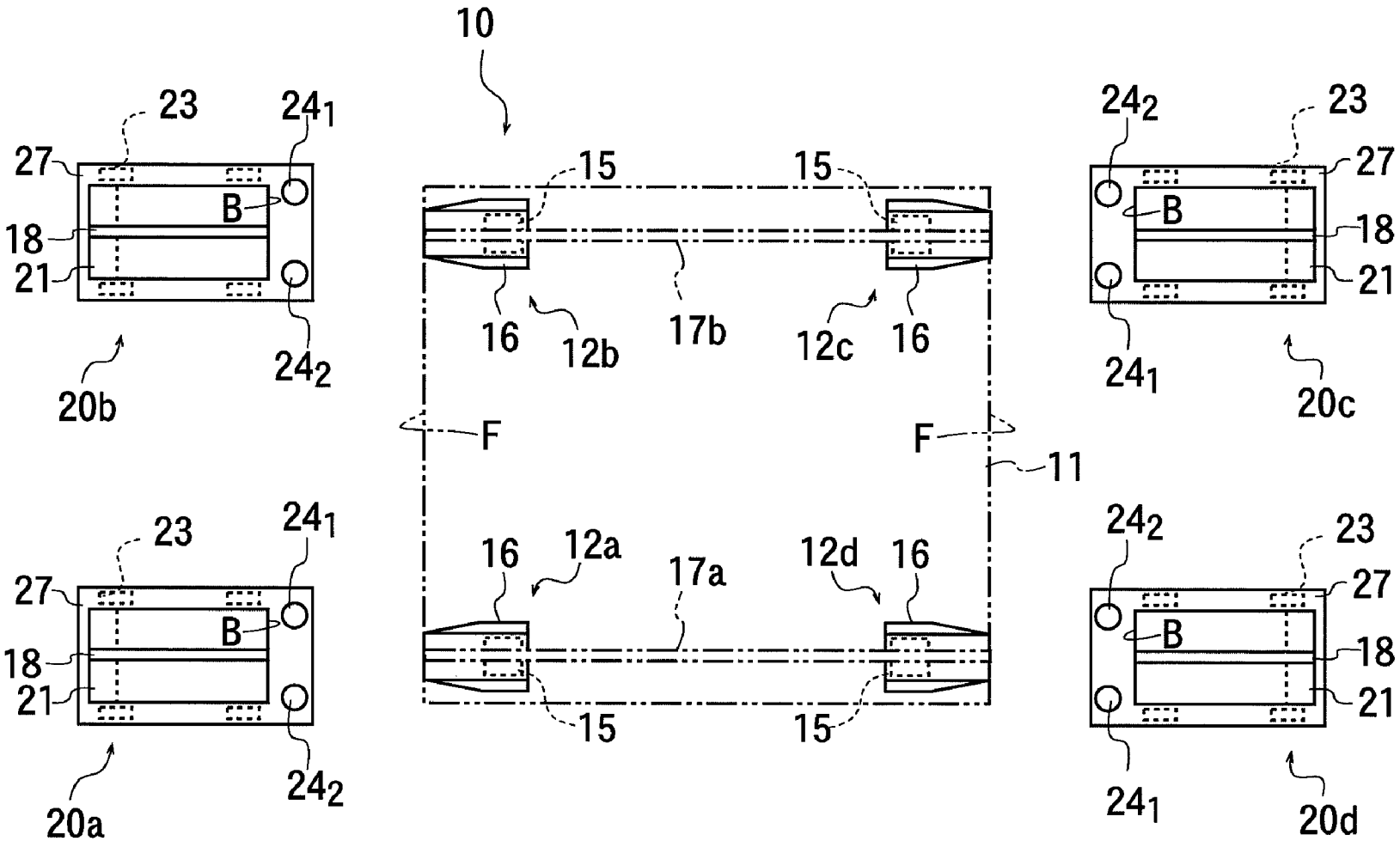
FIG. 7 is a plan view illustrating a procedure of coupling the sub mounting tables with the main mounting table at the real installation site.

Next, the sub mounting tables 20*a* to 20*d* are disposed so as to be oriented to the leg portions 12*a* to 12*d*; and as shown in FIG. 7, the sub mounting tables 20*a* to 20*d* are respectively made to move forward toward the leg portions 12*a* to 12*d* in order that the sub mounting tables 20*a* to 20*d* in the assembled condition made at the temporary installation site can be restored.

As the width of the main positioning members 16 is larger toward the deeper side in the moving direction of the sub mounting tables 20*a* to 20*d*, when the pedestals 27 of the respective sub mounting tables 20*a* to 20*d* get under the main positioning members 16, the main positioning members 16 are inserted between the sub positioning members $\mathbf{24}_1$ and $\mathbf{24}_2$; and when the sub positioning members $\mathbf{24}_1$ and $\mathbf{24}_2$ come in contact with the main positioning members 16, the sub mounting tables 20*a* to 20*d* stop moving forward.

Figure 4:
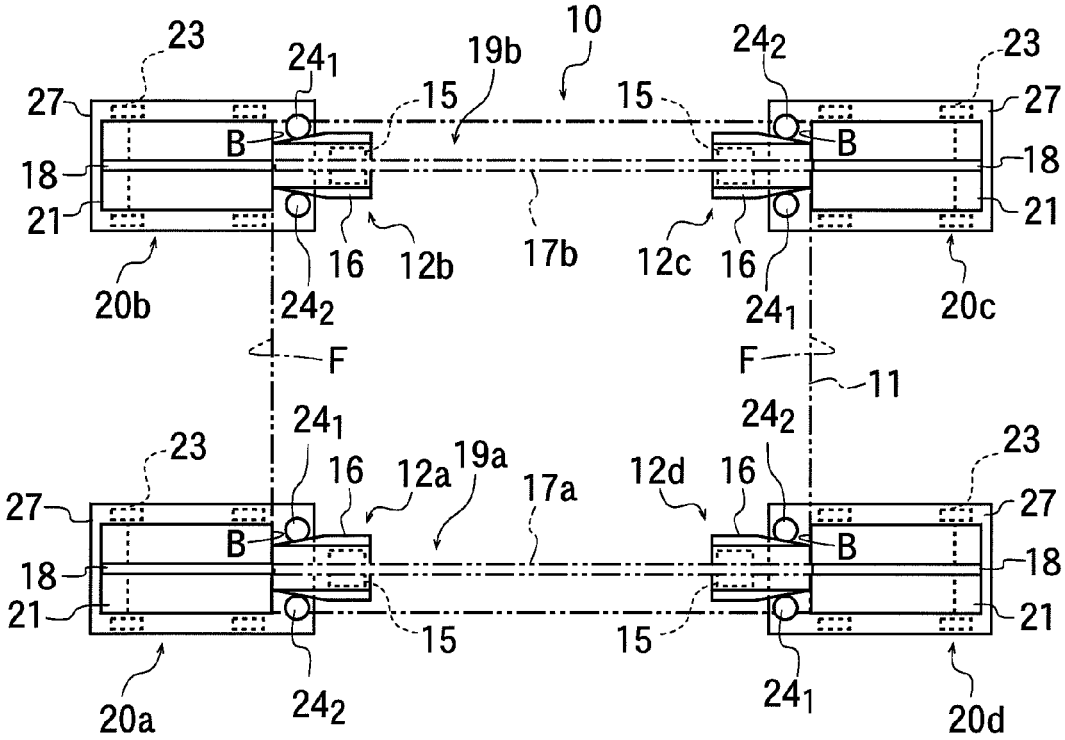
FIG. 4 is an inner plan view illustrating the main mounting table and sub mounting tables in a state of being coupled at the temporary installation site or a real installation site.

This state is the same as shown in FIG. 4; that is, when the floor of the temporary installation site and that of the real installation site are horizontal, and the sub positioning members $\mathbf{24}_1$ and $\mathbf{24}_2$ and the main positioning members 16 are in contact with each other at the same positions as the contact positions that were taken at the temporary installation site, the positional relationship between the sub mounting tables 20*a* to 20*d* and the main mounting table 10 at the temporary installation site is restored.

More specifically, as the sub base plates 21 and the main base plate 11 are in the same condition in both coarsely and finely adjusted conditions, real assembly at the real installation site is completed when the stands 25 of the sub mounting tables 20*a* to 20*d* and the leg portions 12*a* to 12*d* of the main mounting table 10 are coupled and fixed with each other by the coupling members 33, and the pedestals 27 are fixed with respect to the leg portions 12*a* to 12*d*.

However, because the coupling between the sub mounting tables 20*a* to 20*d* and the main mounting table 10 was released and then the sub mounting tables 20*a* to 20*d* and the main mounting table 10 were separated so as to be transported, a small error $E_4$ in positional alignment may have occurred due to vibration, change in temperature, or the like during transportation.

Also, when the surface of the main base plate 11 is reset to be horizontal, due to the real installation site not being horizontal, an error in positional alignment occurs.

Such an error $E_4$ in positional alignment is comparable in size to a fine adjustment error $E_3$, and the state of having the coarse adjustment completed is maintained.

Accordingly, after the surface of the main base plate 11 is made horizontal, when the fixation of the fine adjustment mechanisms 32 is released to have the heights and inclinations in the vertical direction and the horizontal positions and directions of the sub mounting tables 20*a* to 20*d* finely adjusted with the fine adjustment mechanisms 32, and when the stands 25 of the sub mounting tables 20*a* to 20*d* and the leg portions 12*a* to 12*d* of the main mounting table 10 are coupled and fixed with each other by the coupling members 33, then the positions of the sub base plate 21 with respect to the main base plate 11 are changed, which may make the alignment error $E_4$ become small; and thus, the positional alignment error between the main base plate 11 and the sub base plates 21 can be made comparable in size to the fine adjustment error $E_3$ which was there before the transportation.

More particularly, in the stage apparatus 5 to be used in an embodiment of the present invention, for each of the sub base plates 21 of the respective sub mounting tables 20*a* to 20*d*, a positional alignment can be independently performed regardless of positional alignments of the sub base plates 21 of any other of the sub mounting tables 20*a* to 20*d*. In a case of arranging two sub rails on one sub base plate and connecting the two sub rails with the first and second main rails 17*a* and 17*b*, when, in a state such that a positional alignment between one sub rail and the first main rail 17*a* or second main rail 17*b* had been completed, positional alignment between the other sub rail and the first main rail 17*a* or second main rail 17*b* was performed, an error would occur in positional alignment between the sub rail which is finished with another positional alignment, and the first main rail 17*a* or second main rail 17*b*. However, in the stage apparatus 5 to be used in an embodiment of the present invention, as a positional alignment work of one sub base plate 21 does not affect the positional alignment condition of the other sub base plates 21, an error does not occur on the sub base plate 21 having already been subjected to positional alignment.

FIGS. 5(*a*) and 5(*b*) are a plan view and a side view respectively of the stage apparatus 5 that is assembled in the above-discussed procedure at the real installation site and are in a state such that the main rails 17*a* and 17*b* on the main mounting table 10 and the sub rails 18 on the sub mounting tables 20*a* to 20*d* are linearly connected with each other so as to form the first and second extended rails 19*a* and 19*b*, and the gantry 13 is mounted on the first and second extended rails 19*a* and 19*b*.

In the figures, as the gantry 13 is located on the sub mounting tables 20*c* and 20*d* which are disposed outside the main mounting table 10, the cleaning of the print head and the like can be performed at this location. Further, since the gantry 13 is not on a substrate, it is possible to replace a substrate 7 on the main mounting table 10.

As the accuracy of positional alignment between the main base plate 11 and the sub base plates 21 is high, even when the gantry 13 is moved on and in the middle of the sub mounting tables 20*a* to 20*d* and the main mounting table 10 as shown in FIGS. 6(*a*) and 6(*b*), the movement does not cause vibration.

The stands 25 are separable from the carriages 22, and when the stands 25 are fixed to the leg portions 12*a* to 12*d* by the coupling members 33, even when the carriages 22 are removed from under the stands 25 as shown in FIG. 6(*b*), the sub base plates 21 are in a state of being fixed to the main base plate 11.

As described above, in accordance with an embodiment of the present invention, prior to the assembling of the sub mounting tables 20*a* to 20*d* and the main mounting table 10 at a real installation site, in a temporary installation site (for example, in a factory where the stage apparatus 5 has been manufactured) having the positions of the sub base plates 21 and the main base plate 11 aligned with each other in advance, then the sub base plates 21 and the main base plate 11 separated from each other such that the aligned state can be restored, to be transported, which enables assembly thereof at the real installation site.

Incidentally, the coupling members 33 to be used for assembly may be arranged on the sub mounting tables 20*a* to 20*d*, or may be arranged on the main mounting table 10. Also, the coupling members 33 may be arranged to be removable from both of the sub mounting tables 20*a* to 20*d* and the main mounting table 10.

In the foregoing embodiment, the main positioning members 16 are formed of plate-shaped members, and the sub positioning members $\mathbf{24}_1$ and $\mathbf{24}_2$ are formed of rollers in contact with the side surfaces of the main positioning members 16. However, the main positioning members 16 and the sub positioning members $\mathbf{24}_1$ and $\mathbf{24}_2$ are not limited thereto, and can be any types of members that re-create the relative positional relationship between the sub base plates 21 and the main base plate 11. The main positioning members may also be formed of rolls, and the sub positioning members may be formed of plate-shaped members.

Further, in the forgoing embodiment, though the main positioning members 16 were fixed inside the leg portions 12*a* to 12*d*, so that the positional relationship between the main positioning members 16 and the main base plate 11 was fixed, while the sub positioning members $\mathbf{24}_1$ and $\mathbf{24}_2$ were arranged movable and fixable with respect to the pedestals 27. However, the positional relationship between the sub positioning members $\mathbf{24}_1$ and $\mathbf{24}_2$ and the sub base plate 21 may be fixed, and the relative positions between the main positioning members 16 and the main base plate 11 may be arranged so as to be changeable and fixable. In this case, after fixing by the coupling members 33 to follow coarse adjustment, the main positioning members 16 may be moved to come in contact with the sub positioning members $\mathbf{24}_1$ and $\mathbf{24}_2$ so as to fix the positions of the main positioning members 16 relative to the main base plate 11.

Figure 8A:
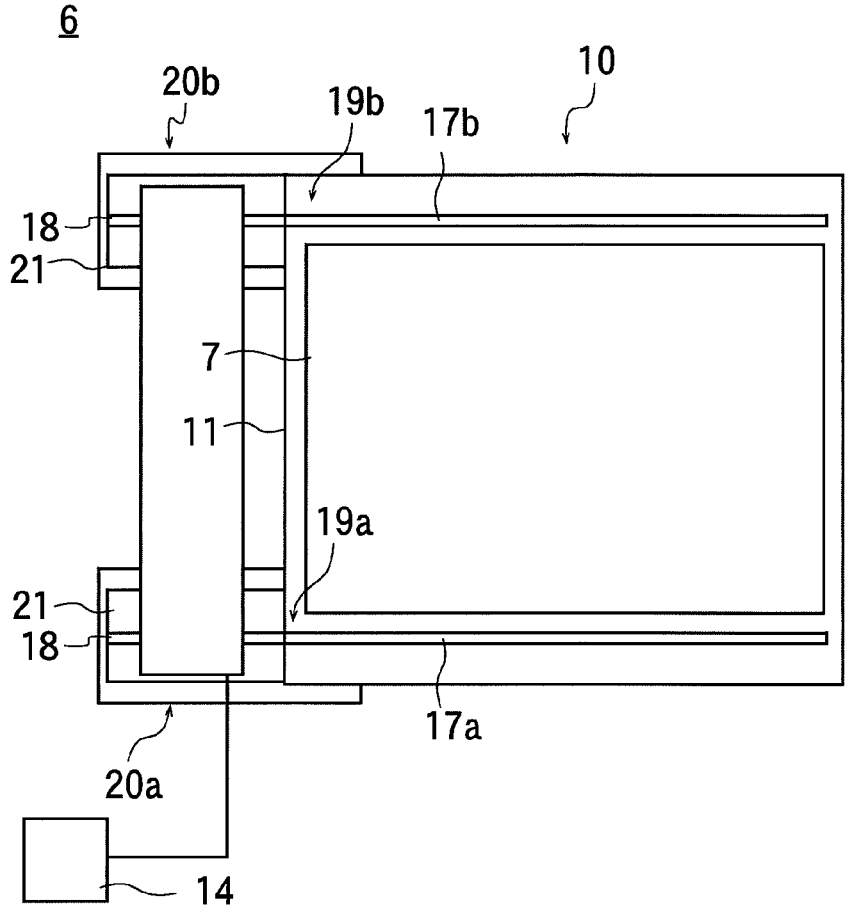
FIG. 8 is a plan view illustrating another example of a stage apparatus to be used in an embodiment of the present invention.
Figure 8B:
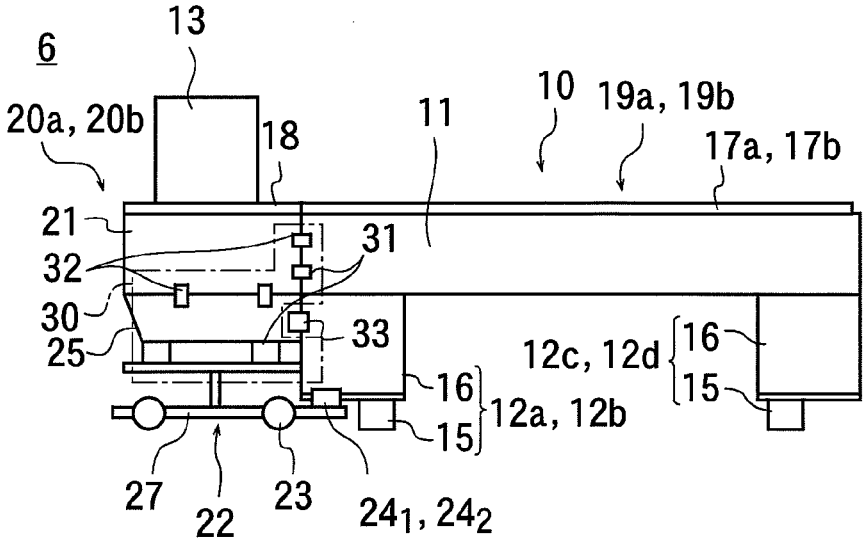
Figure 9A:
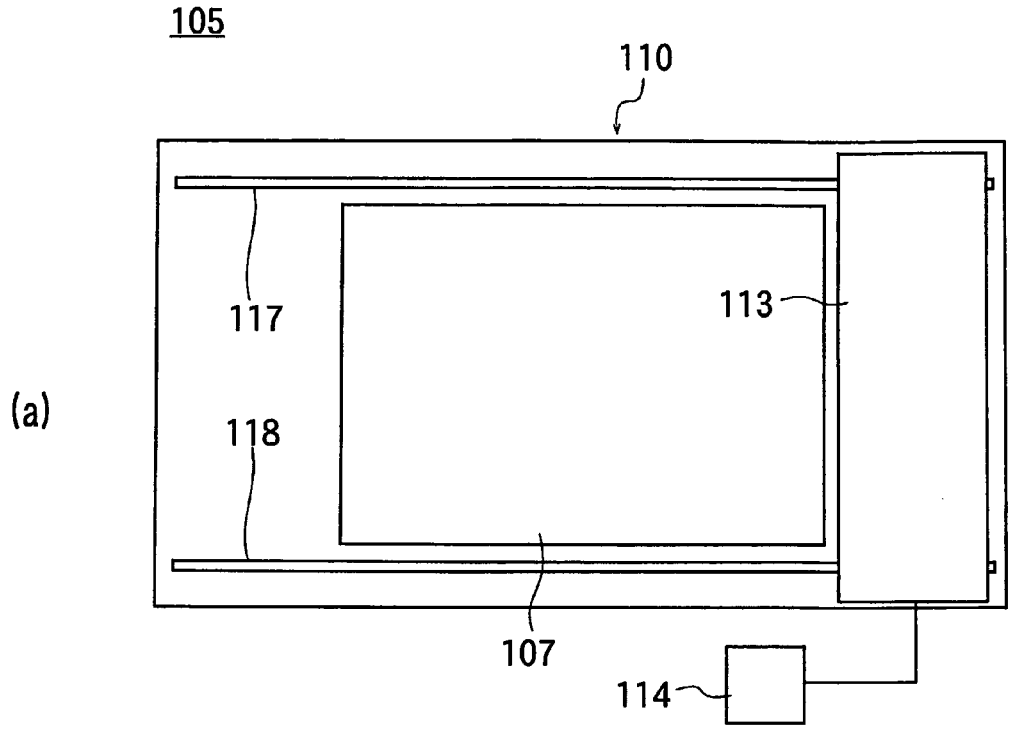
PRIOR ART Fig.9(a)
FIG. 9(*a*) is a plan view (1) of a stage apparatus in a conventional art.
Figure 9B:
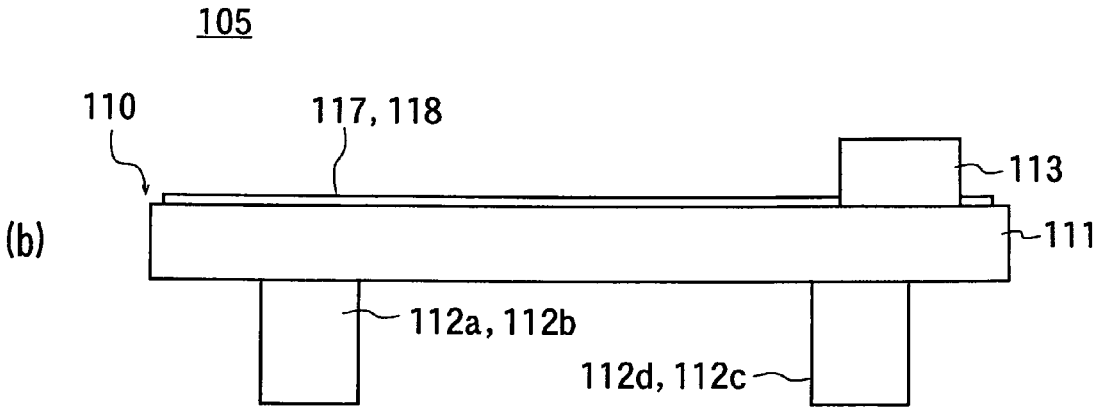
PRIOR ART Fig.9(b)
Figure 10A:
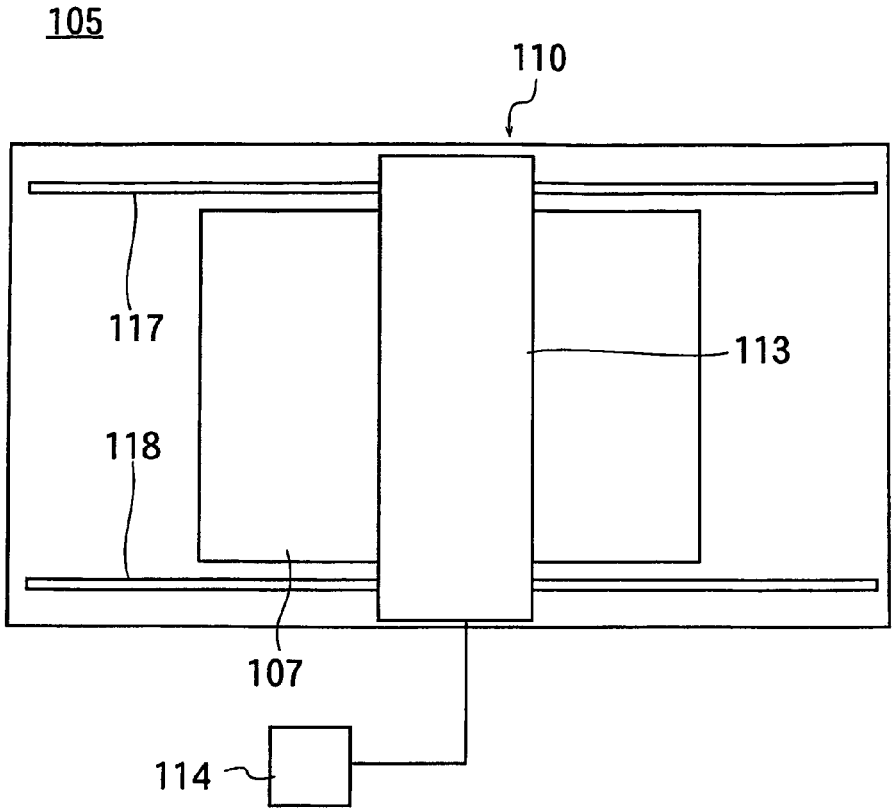
PRIOR ART Fig.10(a)
FIG. 10(*a*) is a plan view (2) of a stage apparatus in a conventional art.
Figure 10B:
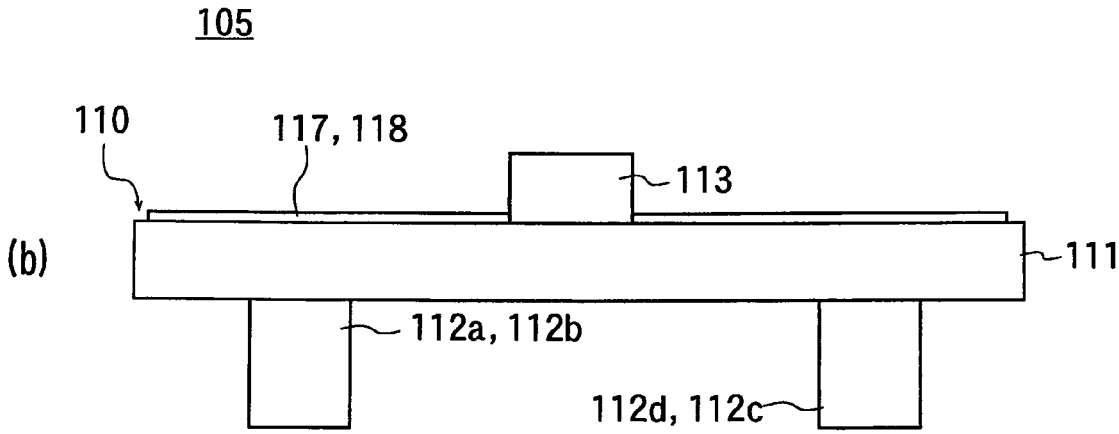
PRIOR ART Fig.10(b)

Incidentally, reference numeral 6 in FIG. 8 represents a stage apparatus for which two sub base plates 21 are connected to one main connecting side F of one main base plate 11, and no sub base plate is connected to the other side.

Further, though in the foregoing embodiment, the gantry 13 is disposed on the main and sub mounting tables 10 and 20*a* to 20*d* of the stage apparatus 5 or 6 in accordance with the present invention to be used as an inkjet device, the invention is not limited thereto. A laser irradiation device may be disposed on the stage apparatus 5 or 6 in accordance with the invention to be used as a heating device, inspection device, or an exposure device, too. Further, a substrate positional alignment device may be used as an aligner.

In short, the stage apparatus 5 or 6 in accordance with the invention is not limited to one for use in an inkjet device.

Further, a movable member is not limited to the gantry 13, and may be one that moves on the main base plate 11 and sub base plates 21 (for example, a mounting table to mount an object of processing, such as a substrate).

What is claimed is:

1. A stage apparatus, comprising:

a main base plate in a quadrilateral shape having four sides;

two sub base plates which are fixed to the same one side out of the four sides of the main base plate such that the sub base plates and the main base plate are separable from one another;

a movable member arranged to be movable between a position above the main base plate and a position above and between the two sub base plates fixed to the main base plate; and adjustment mechanisms which are independently capable of changing the respective heights, inclinations, and the horizontal positions and directions of the sub base plates with respect to the main base plates in each of the sub base plates, wherein each of the two sub base plates is separable from the same one side out of the four sides of the main base plate.

2. The stage apparatus according to claim 1, further comprising:

a first and second main rails which are linearly extended on the main base plate and disposed in parallel to each other; and sub rails that are respectively disposed on the two sub base plates and respectively connected to end portions of the first and second main rails, wherein the movable member runs on the first and second main rails and the sub rails on the two sub base plates and are movable between the position above the main base plate and the position above and between the two sub base plates.

* * * * *